United States Patent [19]

Monjoie

[11] Patent Number: 4,800,047

[45] Date of Patent: Jan. 24, 1989

[54] GAS AND LIQUID CONTACT SHEET AND PACKING

[75] Inventor: Michel W. J. P. R. Monjoie, Brussels, Belgium

[73] Assignee: Engetra S.A., Fribourg, Switzerland

[21] Appl. No.: 160,360

[22] Filed: Feb. 25, 1988

[30] Foreign Application Priority Data

May 13, 1987 [EP] European Pat. Off. ..... 87870069.9

[51] Int. Cl.[4] ..... B01F 3/04

[52] U.S. Cl. ..... 261/112.2; 428/177; 428/183; 428/184; 261/DIG. 72

[58] Field of Search ..... 261/112.2, DIG. 72; 428/177, 183, 184

[56] References Cited

U.S. PATENT DOCUMENTS

| | | | |
|---|---|---|---|
| 3,281,307 | 10/1966 | Moeller | 261/112.2 |
| 3,540,702 | 11/1970 | Uyama | 261/112.2 |
| 3,586,591 | 6/1971 | Munters | 261/112.2 |
| 3,830,684 | 8/1974 | Hamon | 261/112.2 |
| 4,099,928 | 7/1978 | Norback | 261/112.2 |
| 4,344,899 | 8/1982 | Monjoie | 261/112.2 |
| 4,374,542 | 2/1983 | Bradley | 261/112.2 |
| 4,427,607 | 1/1984 | Korsell | 261/112.2 |
| 4,581,183 | 4/1986 | Lefevre | 261/94 |
| 4,604,247 | 8/1986 | Chen et al. | 261/112.2 |
| 4,668,443 | 5/1987 | Rye | 428/183 |

FOREIGN PATENT DOCUMENTS

| | | |
|---|---|---|
| 0028545 | 5/1981 | European Pat. Off. . |
| 0036944 | 10/1981 | European Pat. Off. . |
| 1428875 | 1/1966 | France . |
| 2183704 | 12/1973 | France . |
| 2263808 | 10/1975 | France . |
| 2557472 | 5/1985 | France . |

*Primary Examiner*—Tim Miles

*Attorney, Agent, or Firm*—Walter H. Schneider

[57] ABSTRACT

Trickling sheet (2) comprising in the direction of its first side or base (3) a first zone which is greatly corrugated (5) and a second zone which is slightly corrugated or flat (6), of equal width, these zones being provided with spacer bosses (7) at the two sides of the sheet, the mean plane of the second zone or the plane of the flat zone (6) being offset in such a manner that the tops of the bosses (7) of one of the two faces of the sheet are co-planar. An assembly of such sheets juxtaposed with one another by turning one sheet out of two through 180° about the median line (9) separating the two zones constitutes a packing element with rectilinear channels, without obstacles or awkward recesses or bottlenecks.

19 Claims, 4 Drawing Sheets

GAS AND LIQUID CONTACT SHEET AND PACKING

BACKGROUND OF THE INVENTION

1. Field of the Invention

The present invention concerns installations for bringing a liquid and a gas into contact, and concerns especially atmospheric coolers or cooling towers, provided with a packing means through which the liquid falls due to gravitational force and the gas flows in counter-current to the liquid. The installations for bringing a liquid and a gas into contact comprise a chamber or tower in which the packing means is installed. Such means may be constituted by an assembly of tricking panels or sheets, generally of a profiled type.

The invention relates to a sheet-type packing means for such installations, and also to the sheets of which such a means is constituted.

2. Description of the Prior Art

Such assemblies have been described especially in patents (U.S. Pat. No. 3,830,684) (GB No. 1,495,788), (U.S. Pat. No. 4,344,899) and (U.S. Pat. No. 4,581,183)).

The tricking sheets described for example in U.S. Pat. No. 4,344,899 and U.S. Pat. No. 4,581,183 comprise, in a direction parallel to the crests of the corrugations, that is to say vertically when the sheet is in service, an even number of successive zones of equal extent in this direction but which differ from one another in the amplitude of the corrugations. Along the crest line of the corrugations there may be seen at least one pair of zones constituted by a zone with corrugations of a first amplitude and a zone with corrugations of smaller amplitude or, in the extreme case, of zero amplitude, which zones are connected to one another by a transition zone. The packing elements are constituted by juxtaposition of identical trickling sheets positioned alternately in one direction and in the opposite direction defined by rotation of the sheet through 180° about an appropriate axis which depends on the geometry of the sheet and in particular on the corrugations and points of contact provided in the two kinds of corrugation zones.

These trickling sheets are manufactured from strips of indeterminate length.

Since the zones of different corrugations separated from one another by a transition zone follow one another vertically when the sheets are in place in the packing element in service, the inversion of the corrugations from one zone to the other gives rise to a baffle effect particularly susceptible to soiling in the region of the transition zone.

The channels thus formed follow a tortuous course which does not make for easy maintenance.

Soiling may be due to substances in suspension, in the case of the cooling of dirty, contaminated, or simply inpure water. Moreover cooling towers through which aerated lukewarm water generally passes are particularly prone to the development of various microorganisms, especially bacteria and algae. Not only can these microorganisms, especially the algae, block the channels themselves, but they can also fix the fine substances in suspension in the water, such as particles of sand or silt.

The sheets are generally produced by unwinding strips in the sense of the length of the packing elements, transversely to the crest lines of the corrugations. In this case the width of the strip and the height of the sheets in service are limited by the width of the forming tool.

It is then necessary to stack two or more packing elements to reach the required height for packing means in tower coolers. The relative positions of the packing elements are in this case not very precise because of their low rigidity, not only at the time of assembly but also when subjected to thermal expansion and the turbulence of the water and air. As a result, the channels of one packing element do not correspond to those of the adjacent lower and upper packing elements. This is another cause of forming bottlenecks to the flow of water and air, giving rise to the retaining of substances in suspension and to conditions propitious for the development of microorganisms.

SUMMARY OF THE INVENTION

The present invention has as its object to obviate the disadvantageous mentioned hereinbefore of the packing means proposed in the state of the art.

For this purpose there is provided according to the invention a strip for trickling sheets for a packing means for an installation used for bringing into contact a liquid and a gas flowing in counter-current, of well-defined width and indeterminate length, profiled by being passed in the sense of this length through a corresponding profiling tool the width of which corresponds to that of the strip, characterised in that it comprises over its width two zones of equal width, one strongly corrugated and the other slightly corrugated to the same pitch, without any discontinuity of pitch at the transition between the two zones, each provided with spacer bosses situated to project from the crests of the corrugation on these two faces and spaced along the length of the strip and symmetrically disposed relatively to the median line separating the two zones, and in that the means plane of the strip in its slightly corrugated zone is parallel to the mean plane of the strip in its greatly corrugated zone and is offset by a distance such that the tops of all the bosses of one of the two faces of the strip are in one and the same plane.

In a variant, instead of having a slightly corrugated zone the strip may comprise a flat zone. In this case the spacer bosses are, in the flat zone, situated symmetrically to those of the corrugated zone, the bosses which correspond to one another projecting at the same side of the thickness of the sheet. In this case also the plane of the flat zone is parallel to the mean plane of the sheet in its corrugated zone and is offset by a distance such that the tops of all the bosses of one of the two faces of the strip are in one and the same plane.

From this strip, trickling sheets are cut in the form of rectangles comprising, along one first side of the rectangle, two zones of equal width, one greatly corrugated and the other slightly corrugated or, in the extreme case, flat. These sheets have the characteristics of the strips described hereinbefore, with the qualification that the other second side of the rectangle of the sheets defines the height of the sheets in service and that the spacer bosses are spaced along this second side.

The said trickling sheets are obtained by cutting the strip perpendicularly to the length thereof, the width of the strip defining the horizontal side or base of the sheet in service and the length of piece cut defining the height of the sheet in service.

According to the invention a packing means for an installation for bringing into contact a liquid and a gas flowing in counter-current comprises packing elements constituted by identical trickling sheets of the kind described hereinbefore, the height of a packing element being equal to the height of a sheet in service and the width of a packing element being equal to the horizontal side or base of a sheet in service. In the packing elements the sheets are juxtaposed with one another through the agency of their spacer bosses, one in a first direction and the following one in another direction defined by rotation of 180° from the first direction about the median line separating the two zones. These packing elements are generally formed of an even number of trickling plates, welded or adhesively secured to one another along their mutually contacting bosses. The said packing elements thus have six plane bearing contact faces, four being constituted by the edges or thicknesses of the sheets, and the two others by the aforesaid planes containing the flat tops of the external bosses of the external sheets.

DESCRIPTION OF THE DRAWINGS

Other features and advantages of the invention will become apparent from the following description which refers to the drawings wherein.

In these various Figures like references are used to denote like parts.

DESCRIPTION OF THE PREFERRED EMBODIMENT

Figure 1:
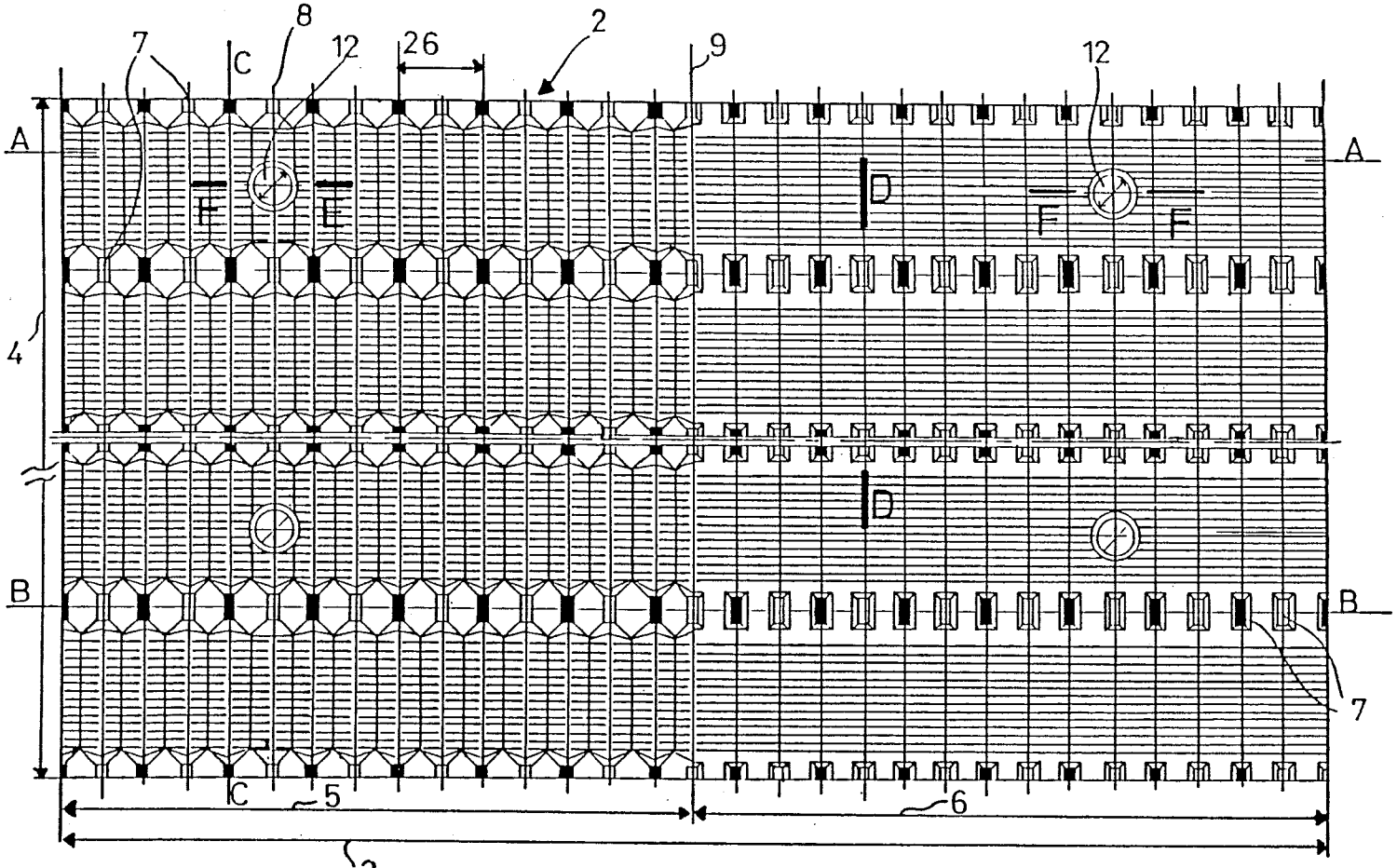
FIG. 1 is a plan view of a trickling sheet.

FIG. 1 shows in plan view a trickling sheet 2 of rectangular form comprising a first side 3 and a second side 4 which defines the height of the sheet in service. Considered along its first side 3 the sheet comprises two zones of equal width, a corrugated zone 5 and the other zone 6 flat, the zones being provided with spacer bosses 7 situated, in the corrugated zone 5, on the crests 8 of the corrugations of the two faces of the sheet.

Bosses 7 are spaced in the direction of the side 4 of the rectangle, that is to say in the direction of the crest lines 8 of the corrugations, and those of the flat zone 6 are situated symmetrically to those of the corrugated zone 5 relatively to the median line 9 separating the two zones. The bosses which correspond to one another project from the same side of the sheet 2. The plane of the flat zone 6 is parallel to the means plane 10 (FIG. 2) of the sheet in its corrugated zone 5, and is offset therefrom by a distance such that the tops of all the bosses 7 of one of the faces of the sheet are in one and the same plane.

The trickling sheets 2 are produced for example from strips of organic polymer such as polyvinyl chloride by known processes, such as thermoforming under a vacuum, using semi-continious methods wherein the strip passes along intermittently (hence the semi-continuous character) through a press provided with profiling moulds.

The sheet 2 is obtained by cutting from the strip at right angles to the length of the strip, the width of the strip defining the horizontal side or base 3 of the sheet in service whereas the length of the piece cut defines the height 4 of the sheet when in service. In the drawings this height is interrupted to bring out its non-limitative character.

The bosses 7 are all of the same height, such that on one of the two sides of the strip the plane 10a defined by the external surface of the flat zone 6 is tangential to the crests 8 of the corrugations of the corrugated zone 5.

Figure 2:
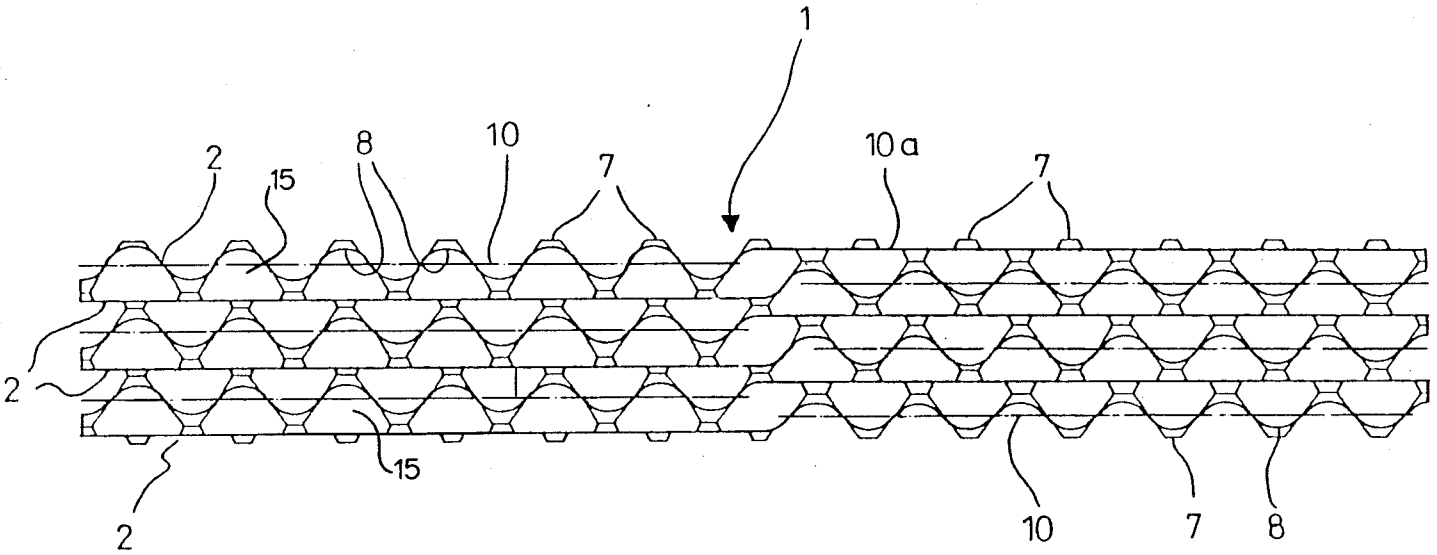
FIG. 2 is a view in section of a packing element formed of six identical trickling sheets such as are illustrated in FIG. 1, alternately turned round through 180° by rotation about the median line separating the two zones of the sheet.
Figure 3A:
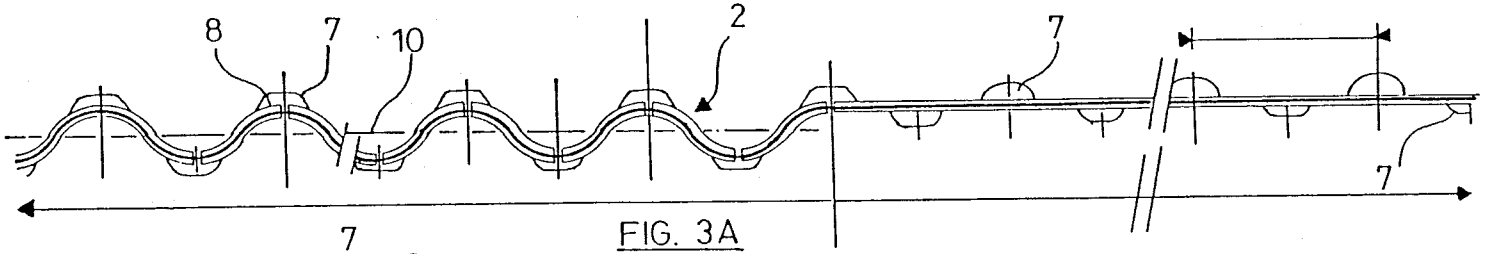
FIGS. 3A to D show four sections through the trickling sheet of FIG. 1, respectively along: A—A, B—B, C—C, D—D.
Figure 3B:
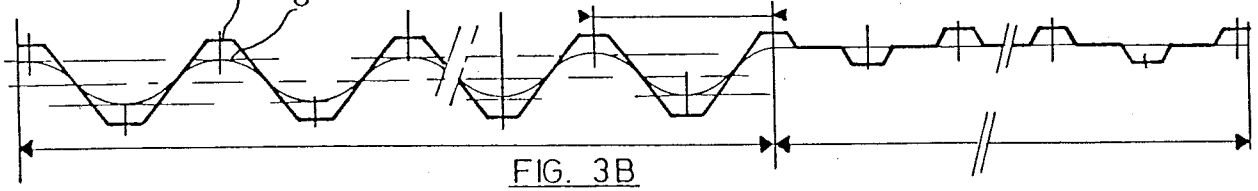
Figure 3C:
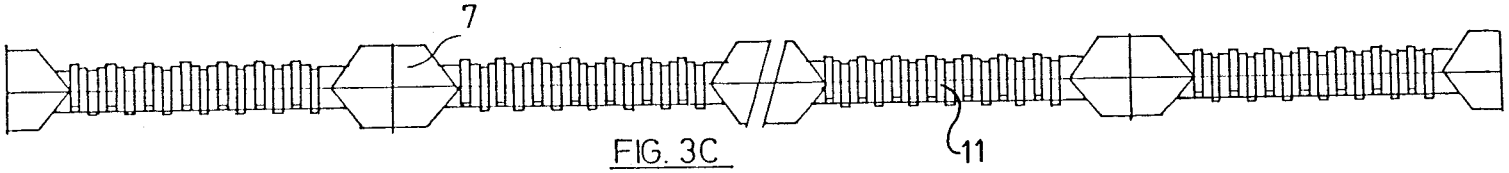
Figure 3D:
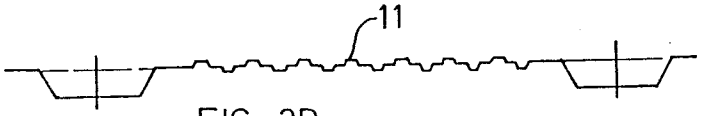
Figure 4A:
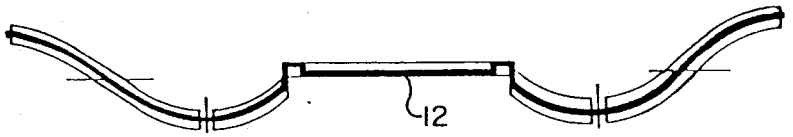
FIGS. 4A to C show three sections through the trickling sheet of FIG. 1 respectively along E—E, F—F, and a main corrugation.
Figure 4B:
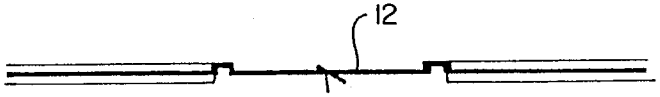
Figure 4C:
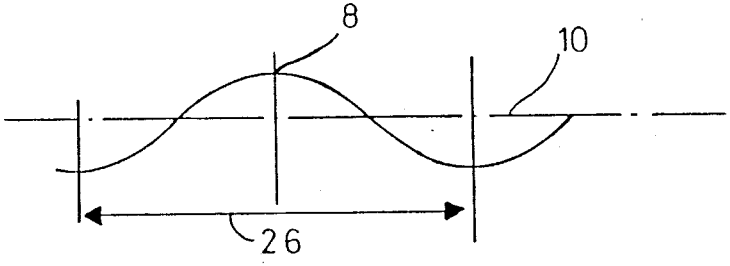

As shown in FIGS. 2, 3A and 4C, the corrugations have a rounded profile with a sinusoidal shape having a constant pitch 26. In FIG. 3B it can be seen that the bosses 7 are flat-headed. The sheet is also provided with secondary corrugations or flutings 11 which are more clearly visible in FIG. 3C and FIG. 3D and which have in this latter case a stepped shape (FIG. 3D). These secondary corrugations 11 are perpendicular to the main corrugations over all of the surface of the two zones 5 and 6 except for that of the spacer bosses 7.

The main corrugations may alternatively be given an angular profile.

In its upper half the sheet 2 is provided with at least one pair of flats 12 having reinforced peripheries, aligned in the same direction as the side 3 of the sheet at the two sides of the median line 9 separating the two zones 5 and 6 and at an equal distance from this line. FIGS. 4A and 4B show these flats on a larger scale respectively in the corrugated zone (section E—E) and in the flat zone (section F—F).

The sheet illustrated comes from a strip wherein the pairs of flats are arranged along the length of the strip at intervals equal to the smallest height intended for the packing elements.

When it is desired to suspend a packing group constituted by such sheets, the flats of the upper row are cut out to form in this way a pair of aligned holes at the two sides of the median line 9 separating the two zones 5 and 6 and at equal distances from this line. The reinforcements of the flats are intended to reduce the deformation when the packing groups are suspended.

The packing elements are constituted by trickling sheets 2 identical to one another such as have been described hereinbefore. The height of a packing element is equal to the height 4 of a sheet in service, whilst the width of the packing element is equal to the base 3 of the sheet. In this packing element the sheets are juxtaposed with one another through the intermediary of their spacer bosses 7 and secured to one another adhesively or by welding at all of or some of their bosses, one in a first direction and the following sheet in another direction defined by rotation through 180° from the first direction about the median line 9 separating the two zones. The packing elements thus constituted have six flat bearing contact faces, four being constituted by the edges or thicknesses of the sheets and the two others by the aforesaid planes containing the flat tops of the external bosse 7 of the external sheets. A packing element of this kind designated 1 is shown in section in FIG. 2.

There is no superimposition of packing elements to constitute the packing means.

As is shown, the channels 15 thus formed in the packing element do not have any awkward recesses, bottlenecks or asperities. Moreover as they come from a single origin they are perfectly straight. As a result there is little retention of substances which are in suspension in the water. The packing element is not favourable for the development of algae and microorganisms of various kind, and yet is easy to clean.

Moreover the geometry of the sheets, also illustrated in FIG. 2, makes it easy to store them and transport them with a minimum of volume, the fact that all the sheets face in the same direction, without spacer elements, ensuring very slight deformation of the sheets under the weight of the stack and also good stability of the groups of sheets and the packing elements since the tops of the bosses are situated in one and the same plane.

The invention is not of course limited to the details set forth hereinbefore.

I claim:

1. A trickling sheet of rectangular form for a packing means for an installation used for bringing into contact a liquid and a gas flowing in counter-current, characterised in that it comprises, as considered along a first side (3), two zones of equal width the one zone corrugated (5) and the other zone, in comparison, being essentially flat (6), both provided with spacer bosses (7) situated, in the corrugated zone (5), on the crests (8) of the corrugations on both its faces and spaced in the same direction as the other second side (4) of the rectangle, defining the height of the sheet when in service, these bosses being situated, in the flat zone (6), symmetrically with the previously-mentioned bosses in the corrugated section (5) with respect to the median line (9) separating the two zones (5 and 6), the bosses (7) which correspond to one another projecting from the same side of the thickness of the sheet, and in that the plane (10*a*) of the flat zone (6) is parallel to the mean plane (10) of the sheet in its corrugated zone (5) and is offset by a distance such that the tops of all the bosses (7) of one of the two faces of the strip are in one and the same plane.

2. A trickling sheet according to claim 1, characterised in that the first side (3) of the rectangle is its width and the second side (4) its length.

3. A trickling sheet according to claim 1, characterised in that the first side (3) of the rectangle is its length and the second side (4) its width.

4. A trickling sheet according to claim 1, characterised in that the rectangle is a square.

5. A trickling sheet according to claim 1, characterised in that the corrugations have a rounded profile of sinusoidal aspect.

6. A trickling sheet according to claim 1, characterised in that the corrugations have an angular profile.

7. A trickling sheet according to claim 1, characterised in that the bosses (7) have flat heads.

8. A trickling sheet according to claim 1, characterised in that it is provided with secondary corrugations of slight thickness or flutings (11) preferably with a stepped angular profile, perpendicular to the main corrugations, on the entire surface of the two zones (5 and 6) except for that of the spacer bosses (7).

9. A trickling sheet according to claim 1 in which the other zone is flat.

10. A trickling sheet according to claim 9, characterised in that all the bosses (7) are of the same height, such that in this way, at one of the two sides of the strip, the plane defined by the external surface of the flat zone (6) is tangential to the crests (8) of the corrugations of the corrugated zone (5).

11. A trickling sheet according to claim 1 in which the other zone is slightly corrugated.

12. A trickling sheet according to claim 11, characterised in that all the bosses (7) are of the same height, thus defining at one of the two sides of the strip a single plane tangential to the crests (8) of the corrugations of the two zones (5 and 6).

13. A trickling sheet according to claim 1, characterised in that it is provided in its upper half with at least one pair of flats (12) with reinforced peripheries, aligned in the same direction as the base (3) of the sheet at the two sides of the median line (9) separating the two zones (5 and 6) and at an equal distance from this line (9).

14. A trickling sheet according to claim 13, characerised in that it is made from a strip wherein the pairs of flats (12) are arranged along the length of the strip at intervals equal to the smallest height proposed for the packing elements (1).

15. A trickling sheet according to claim 14, characterised in that it is perforated with at least one pair of holes aligned in the same direction as the base (3) of the sheet at the two sides of the median line (9) separating the two zones (5 and 6) and at an equal distance from this line (9).

16. A packing means for use in an installation for bringing into contact a liquid and a gas flowing in counter-current, comprising packing elements (1), comprising a plurality of trickling sheets (2), according to claim 1, the height (4) of a packing element being equal to the height (4) of a sheet when in service, and the width of a packing element being equal to the horizontal side or base (3) of a sheet in service.

17. A packing means according to claim 16, characterised in that the sheets (2) are juxtaposed with one another through the intermediary of their spacer bosses (7), one in a first direction and the following in another direction defined by rotation through 180° from the first direction about the median line (9) separting the two zones (5 and 6).

18. A packing means according to claim 17, characterised in that the packing elements (1) are formed of an even number of trickling sheets (2).

19. A packing means according to claim 18, characterised in that the packing elements (1) have six plane bearing contact faces, four being constituted by the edges or thicknesses of the sheets (2) and the two others by the aforesaid planes containing the flat tops of the external bosses (7) of the external sheets (2).

* * * * *